US005771772A

United States Patent [19]

Gorst et al.

[11] Patent Number: 5,771,772

[45] **Date of Patent: *Jun. 30, 1998**

[54] DRIVE DEVICES

[75] Inventors: John B. Gorst, Kendal; David Andrew Eaglestone, Millwood, both of United Kingdom

[73] Assignee: Vickers Shipbuilding & Engineering Limited, United Kingdom

[ * ] Notice: The term of this patent shall not extend beyond the expiration date of Pat. No. 5,495,788.

[21] Appl. No.: 567,325

[22] Filed: Dec. 5, 1995

Related U.S. Application Data

[63] Continuation-in-part of Ser. No. 311,368, Sep. 23, 1994, Pat. No. 5,495,788, which is a continuation of Ser. No. 91,332, Jul. 12, 1993, abandoned.

[30] Foreign Application Priority Data

Jul. 15, 1992 [GB] United Kingdom ..... 9215052

[51] Int. Cl.[6] ..... F41A 5/36

[52] U.S. Cl. ..... 89/4.1; 89/20.4; 89/45

[58] Field of Search ..... 89/4.1, 20.4, 45

[56] References Cited

U.S. PATENT DOCUMENTS

| | | | |
|---|---|---|---|
| 436,899 | 9/1890 | Maxim | 89/20.4 |
| 531,157 | 12/1894 | Canet | 89/20.4 |
| 3,598,016 | 8/1971 | Chiabranoly | 89/157 |
| 5,495,788 | 3/1996 | Gorst et al. | 89/4.1 |

*Primary Examiner*—J. Woodrow Eldred
*Attorney, Agent, or Firm*—Bromberg & Sunstein LLP

[57] ABSTRACT

A drive device for the breech mechanism of a gun comprises driving and driven members connected to first and second elements, respectively wherein one of the elements is movable with respect to the other. The driven and driving members are separable as the elements move apart and re-engage as the elements come together. The connections between the members and elements permit the driving and driven members to execute a rotary motion about a common axis when the members are engaged together whereby energy is transferred from the driving member to the driven member.

4 Claims, 10 Drawing Sheets

DRIVE DEVICES

This application is a continuation-in-part application Ser. No. 08/311,368 filed on Sep. 23, 1994 now U.S. Pat. No. 5,495,788 which is a continuation of application Ser. No. 08/091,332, filed on Jul. 12, 1993, now abandoned.

This invention relates to drive devices and more particularly, but not exclusively is concerned with drive devices for actuating artillery mechanisms such as automatic or semi-automatic systems for the operation of the breech mechanisms of field artillery.

The current trend in military philosophy is to use highly trained mobile forces which can be rapidly deployed to any troublespot. In order to operate effectively when deployed, they must be supplied with the appropriate equipment to enable them to complete their mission. In the case of ground forces, this often means field artillery and, to meet this requirement, new ultra lightweight equipment has been developed. A feature of this equipment is that it can be transported, either as a single load by a medium-size battlefield helicopter, or in dismantled sections by smaller helicopters.

Figure 2:
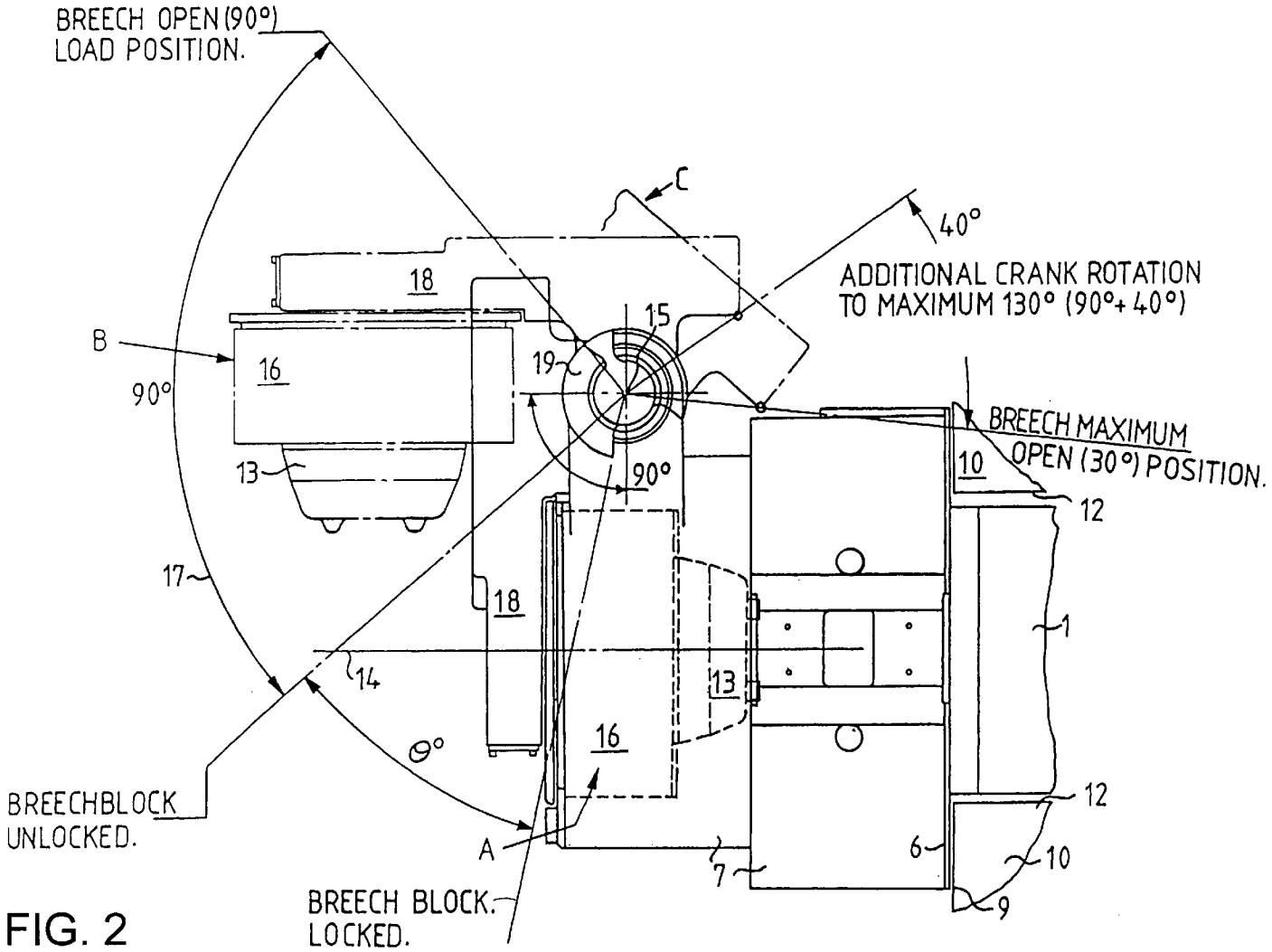

In order to achieve the ultra lightweight required, radical new design concepts have been evolved. In some cases these concepts have required design modifications or new ideas to give the minimum overall weight and most ergonomically usable design. For example conventional breech opening mechanisms use a cam and lever arrangement and normally can open the breech only to the 90° position (B on FIG. 2 of the accompanying drawings). When the gun is horizontal (0°), as shown in FIG. 2, 90° opening is acceptable (though not ideal), but when the gun is at high elevation (e.g. +70°), it is far from convenient. The access problem is compounded if the breech is well forward of the trunnion bearing in the run out position. While the cam and lever system can open the breech (to 90°) using run out energy, the problems created by the length of the levers required due to the run out position of the gun, the need for access to inspect the barrel during loading, and the difficulty actually of closing the breech when the gun is at high angles of elevation, make the conventional system unacceptable.

A further disadvantage of the cam and lever system is that the breech must be closed by human intervention to disengage the cam and lever and reset it for the next cycle of operation. This involves physical effort.

As an alternative to the cam and lever system, a hand-pumped hydraulic mechanism has been developed. Though this works well, it is slower in its operation than ideally required. It is a strategy of highly mobile forces, as herein before mentioned, to arrive unexpectedly, deliver a lightning 'surgical' strike (which could include a heavy artillery barrage) in order to achieve their objective, and then depart. Clearly, in such a situation, the maximum rate of fire achievable is required.

There is thus a need for an ultra lightweight, quick-acting breech opening and closing mechanism which requires the minimum of physical effort and which can be fully or semi-automatic requiring only the pressing of buttons or operation of simple control levers, i.e., where negligible physical effort is required.

It is an object of the present invention to provide a drive device suitable for use in such a mechanism.

According to one aspect of the present invention there is provided a drive device comprising i) a driving member, ii) a driven member, iii) first and second elements wherein the second element is moveable relative to the first element between a first position at which the first and second elements abut, and a second position at which the first and second elements are spaced apart, the arrangement being such that the second element approaches and contacts the first element on returning to the first position, and iv) means of storing energy derived from the coming together of the elements and of transferring the energy to the driving member thereby to drive the driven member.

Preferably, the driving member is connected to the first element and the driven member is connected to the second element so that the driving member and the driven member are separable and re-engageable as the elements move between their second and first positions. In a preferred embodiment the connection between said driving member and said first element and between said driven member and said second element permit, when the driving and driven members are engaged, said driving and driven members to execute a rotary motion about an essentially common axis. Generally, the kinetic energy generated by the coming together of said elements is stored for subsequent use when said driving and driven members are fully re-engaged. Advantageously, the energy is stored in the form of pressure energy by the compression of a working fluid by a means operated by the coming together of said elements. In this case, the compressing means is preferably such as to reset itself when said elements are separated.

Advantageously, a shock absorber is incorporated in said device to protect said device, and components connected thereto, from excessive forces arising during the coming together of said elements.

The drive device is particularly useful for actuating mechanisms in a gun.

Accordingly, a second aspect of the present invention provides a gun including a power-operated mechanism and a drive device as hereinbefore defined for actuating said mechanism.

In a first embodiment of this aspect of the invention, the mechanism to be actuated is a loading tray for feeding ammunition into the breech of the gun.

In a second embodiment of this aspect of the invention, the mechanism to be actuated is the breech operating mechanism of the gun. In this case, the drive device is used to provide a power train from the cradle to the breech mechanism. In such an application, when the gun is fired, the barrel and breech mechanism recoil along the cradle and recuperation and run out systems return the moving mass to its preset position. At this preset position, the driving and driven members of the device re-engage so that a drive train is re-established whereby power may be transmitted from an energy store on the cradle to the breech operating mechanism for the purposes of opening and closing the breech.

In this embodiment, the first element, to which the driving member is connected, is a beating plate in the cradle. The second element, to which the driven member is connected, is a part of the breech structure of the gun. When the recuperation/run out is complete, this part of the breech structure comes to rest in hard contact with the beating plate; this contact thus defines the juxtapositioning of the driving and driven members and hence their re-engagement. Preferably, the drive transmission occurs via rotation of the driving member causing an equal angular rotation of the driven member about an essentially common axis.

It is further preferred that the energy to be transmitted via the driving and driven members is generated by the movement of a piston in a cylinder compressing hydraulic fluid into a gas-filled accumulator. The cylinder is preferably fixed, e.g. in relation to the beating plate, and the piston is extendable outwards from the cylinder, e.g. by a spring, during the recoil and forced back into the cylinder during the recuperation via contact with the breech structure. Advantageously a shock absorbing means is incorporated into the piston rod which drives the piston to minimise the risk of damage due to shock loading, e.g. possible impact with the breech structure during the recuperation motion.

The driving and driven members may be of block, part circular or part annular shape. Preferably, they separate and re-engage in a first direction and are held firmly together in the engaged position so that said driving member may impart rotary motion to said driven member with both said driving and driven members rotating about an essentially common axis lying in a second direction. Advantageously, said first and second directions are essentially at right angles to each other.

Rotary motion may be provided to said driving member via a gearwheel mounted coaxially fast with said driving member and rotatable about said essentially common axis. A gear rack may be provided to mesh with said gearwheel to provide said rotary motion to said driving member, said gear rack being movable in both a first sense to cause rotary motion of said gearwheel in a first sense and in a second sense to cause rotary motion of said gearwheel in a second sense opposite to that of said first sense.

The energy required to move said gear rack in said first and second senses is supplied from that obtained and stored by virtue of the coming together of said two elements.

The driving and driven members may have concave part-circular inner faces extending for less than half the circumference of a circle and be disposed about the input drive shaft of the breech operating mechanism. Adjusting bolts are preferably provided so that the driving and driven members are in direct, or close, contact with each other. The driven member is fast with the input drive shaft of the breech operating mechanism so that, when the driving member is caused to rotate, the driving and driven members and the shaft all turn together essentially as a solid body about the axis of the shaft.

When the gun is fired, the breech operating mechanism and the driven member move away under the recoil leaving the driving member static on its mounting in relation to the cradle and beating plate. When the run out is complete and the breech structure is hard against the beating plate, the driven member becomes re-engaged with the driving member via the adjusting bolts. Generally, the line of engagement of the driving and driven members is parallel to the axis of the gun and the common axis of the breech operating mechanism input drive shaft and the rotation of the driving and driven members is perpendicular to the axis of the gun resulting in an angle of essentially 90° between the two axes.

In this preferred example, the driving member is fast with the gear wheel and meshes with the gear rack which forms part of a hydraulically operated actuator. The actuator is fast with the cradle of the gun so that the axis of rotation of the gear wheel and driven member is essentially the same as the axis of the breech operating mechanism input shaft. Thus hydraulic actuation in one direction will rotate the gearwheel, driving member, driven member and shaft in a first direction to unlock and open the breech and actuation in the opposite direction will close and lock the breech.

The hydraulic power for the operation of the actuator is derived from the stored supply created in the gas-filled accumulator by the action of the piston driven by the movement of the breech structure in the recuperation/run out phase. Forward and reverse valving is provided to control the direction of operation of the actuator, i.e. to open or close the breech. The hydraulic circuits include all the appropriate non-return valves, pressure relief valves, etc., plus a hand pump for initial pressurisation of the system. Preferably, a shock absorber is provided between the end of the piston rod and the point of contact with the second element (i.e the aforesaid part of the breech structure).

The recuperating motion may result in a significant impulse when the breech structure strikes the end of the piston rod (which drives the piston in the cylinder to generate the pressurised working fluid). The shock absorber may consist of spring, hydraulic-or pneumatic means, or combinations of these means. The shock-absorber is such as to generate a reaction to commence movement of the piston rod before metal-to-metal contact with the breech structure actually occurs.

Preferably a means is provided to react to the re-establishment of hard contact between the elements (the breech structure and the beating plate) and the re-engagement of the driving and driven members such that the hydraulic actuator may not be operated prematurely. This means may be in the form of a safety valve in the hydraulic circuit which blocks all fluid flow to and/or from said hydraulic actuator until said driving and driven members are fully re-engaged. Alternatively said means may be a device to operate the hydraulic actuator as soon as said driving and driven members are fully re-engaged to open the breech ready for reloading.

A further means may be provided to close the breech after the gun has been loaded by initiating the operation of the hydraulic actuator once a preset point of the loading cycle has been reached.

In a preferred design, the final few millimeters of the run out, i.e. just as hard contact is being re-established between the breech structure and the beating plate, operates a safety valve, e.g. by pressing a plunger, to open the hydraulic circuits to the flow of fluid when the actuating valve(s) are opened, e.g. by manual means. Also, the plunger movement may be used to initiate the breech opening cycle, e.g. via a mechanical, hydraulic or electrical link, i.e. semi-automatic operation.

A similar device may be incorporated elsewhere on the cradle to react to a later point in the reloading cycle, e.g. the return to its rest position of the shell loading tray, and operate the hydraulic circuit to close the breech to provide a fully automatic operation.

If desired, means may also be included for providing a quantity of more permanently stored energy to actuate the driving member before the first firing of said gun or at any other time when the energy derived from the collision between the elements is inadequate.

According to a third aspect of the invention, there is provided a gun comprising:

(1) a barrel and breech mechanism slidably mounted in a supporting structure wherein, after firing, said barrel and breech mechanism recoil within said supporting structure before returning, under the action of a recuperation system, to a preset position relative to said supporting structure; and (2) a drive device comprising a driving member arranged to transmit rotary motion to a driven member, which members are engaged at said preset position but separate as said barrel and breech mechanism recoil and re-engage at the completion of the recuperation/run out motion when said barrel and breech mechanism return to said preset position, wherein said driven member is rotatably fast with a rotatable input shaft which operates the breech opening and closing mechanism; the drive device further including (i) an energy generation and storage system wherein a portion of the energy of the recoil, which is temporarily stored in the recuperation system and subsequently used to drive the recuperation/run out motion of said barrel and breech mechanism, is converted into more permanently stored energy for use after said run out is complete and said driving and driven members are fully re-engaged at said preset position;

(ii) a means of using said more permanently stored energy to impart rotary motion to said driving member of said device; and (iii) a control means able to:

a) initiate and control the rate of angular movement and/or angle of said rotary motion of said driving member;

b) control the direction of said rotary motion of said driving member;

c) ensure that said rotary motion does not occur prior to full engagement of said driving and driven members at said preset position;

d) ensure that, even when said driving and driven members are fully engaged, said rotary motion is supplied only at one or more predetermined points in the loading cycle of the gun or when specifically demanded by the operation of safety-controlled operating means; and e) control the conversion of said portion of the energy of the recoil into said more permanently stored energy, the quantity of such stored energy, the operation of the system for storing such energy, and the use of such stored energy for imparting said rotary motion.

Figure 1:
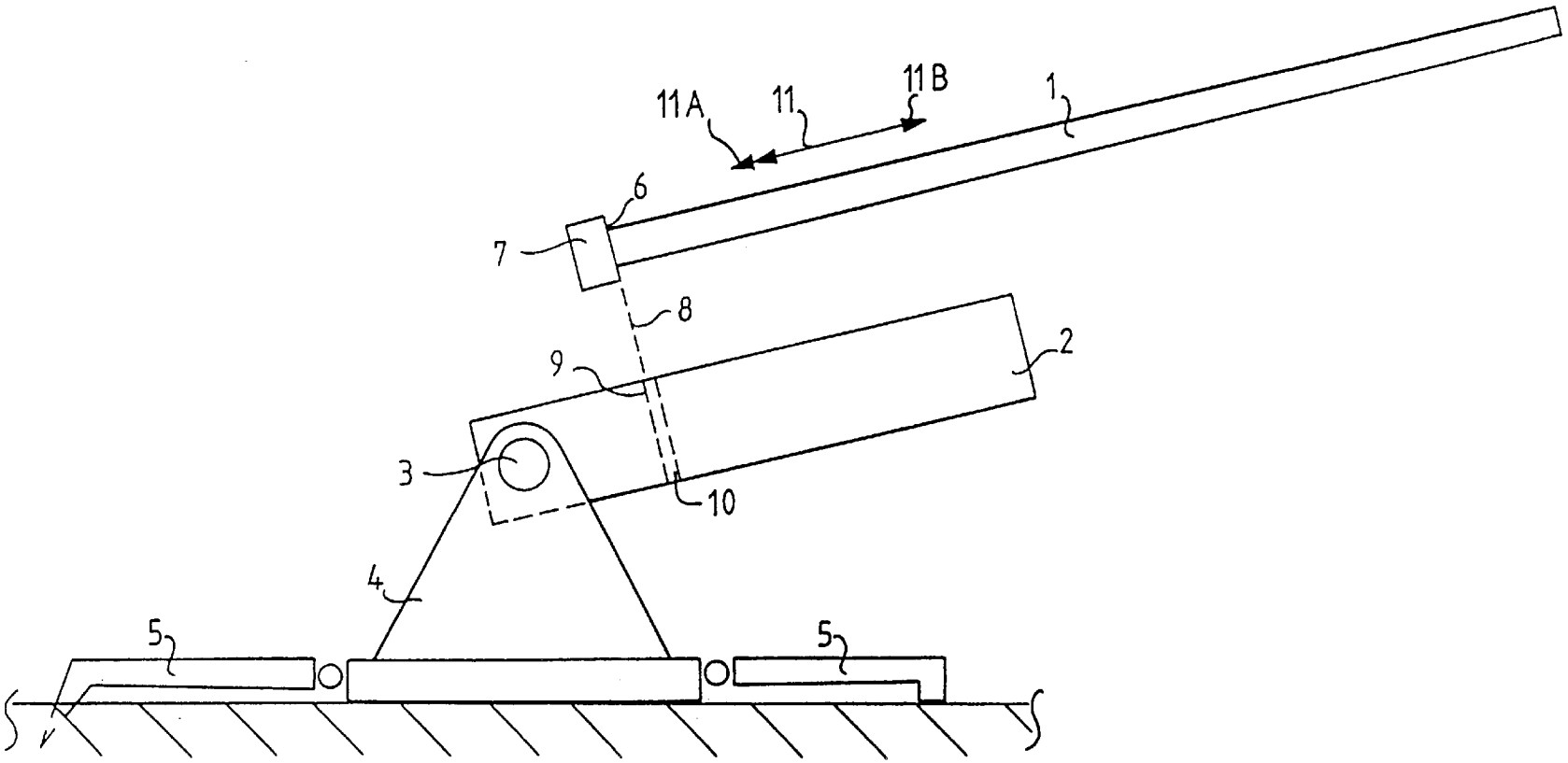
Figure 3:
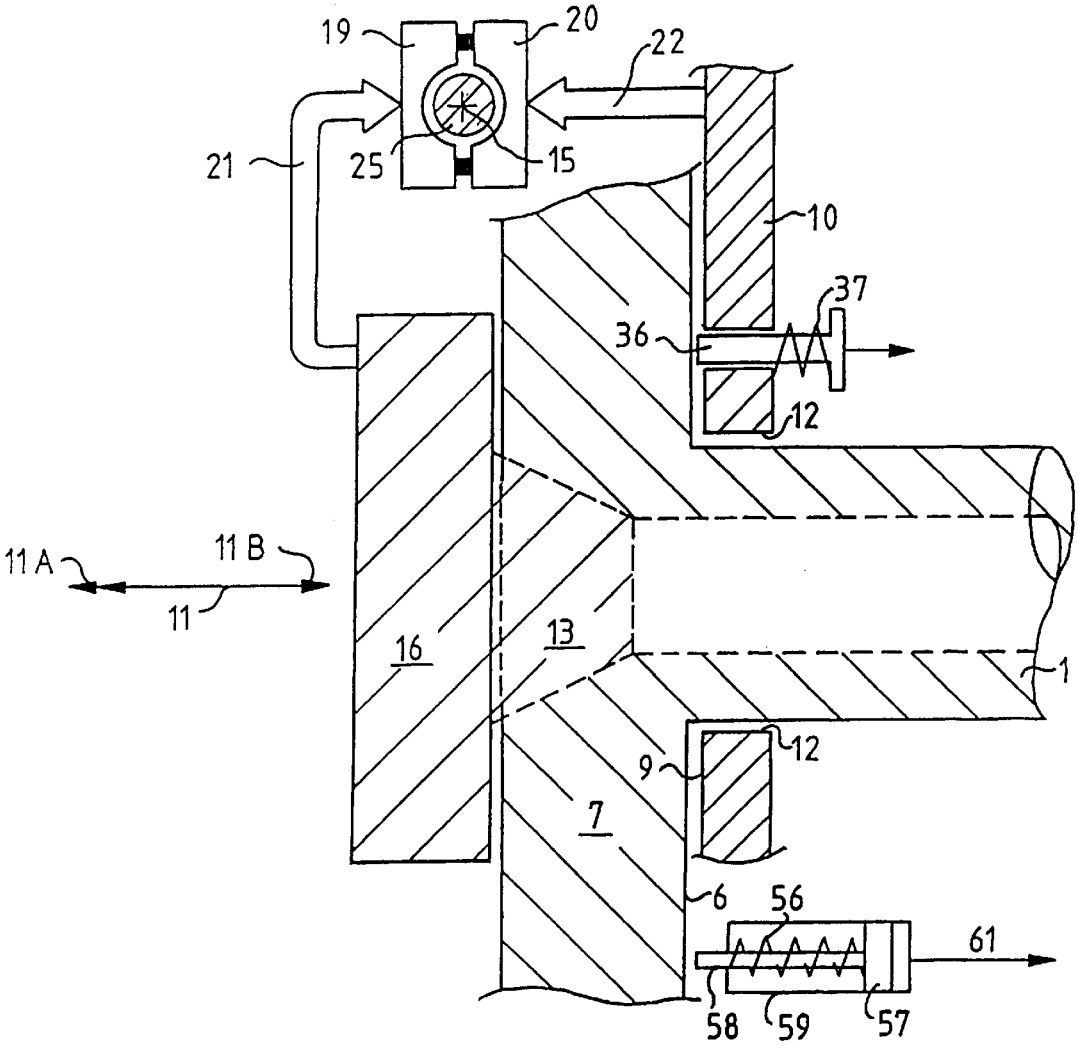
Figure 4:
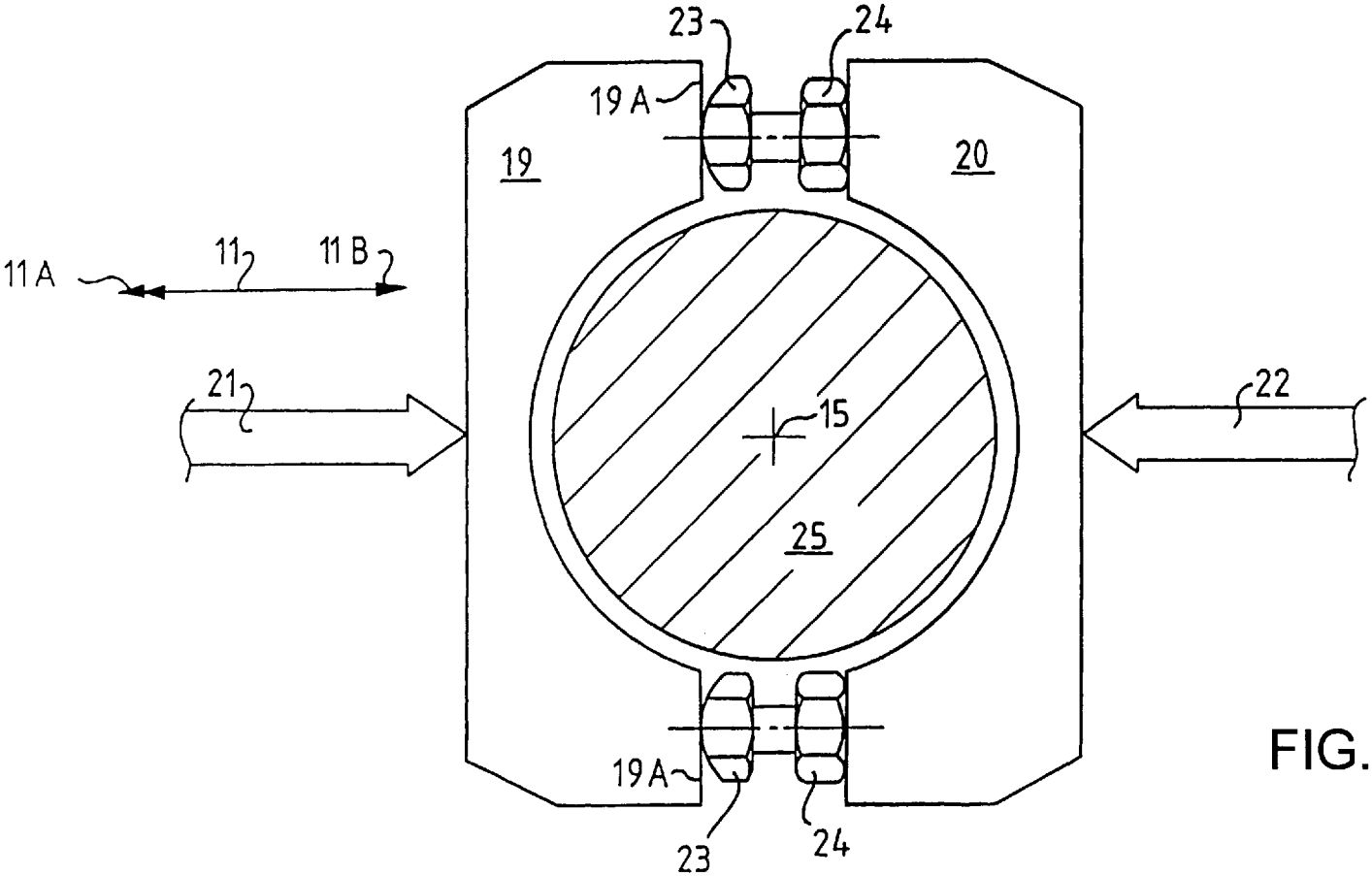
Figure 5:
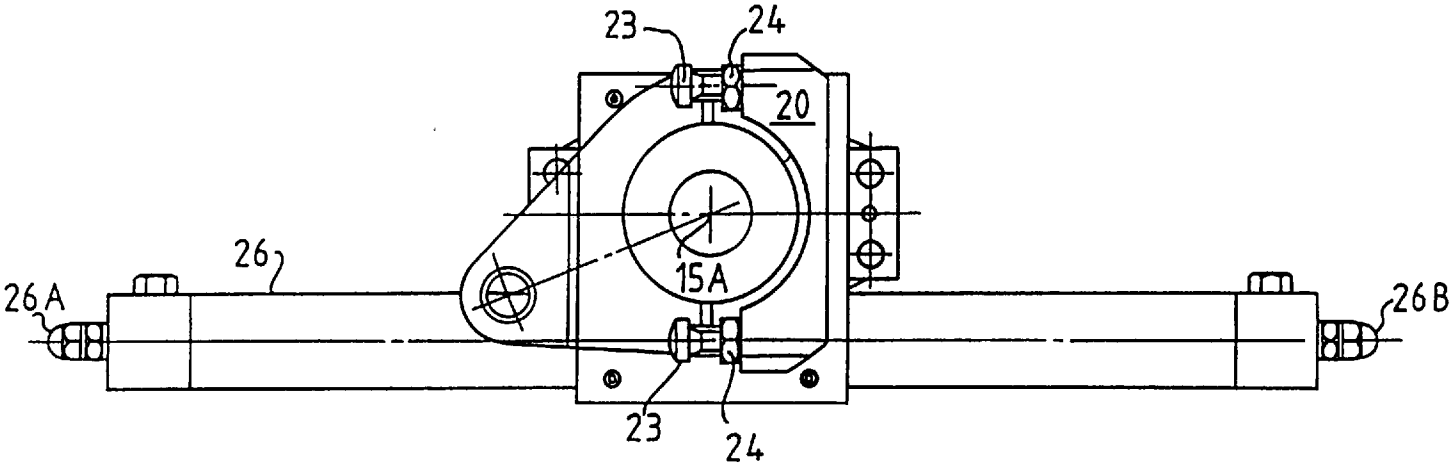
Figure 6:
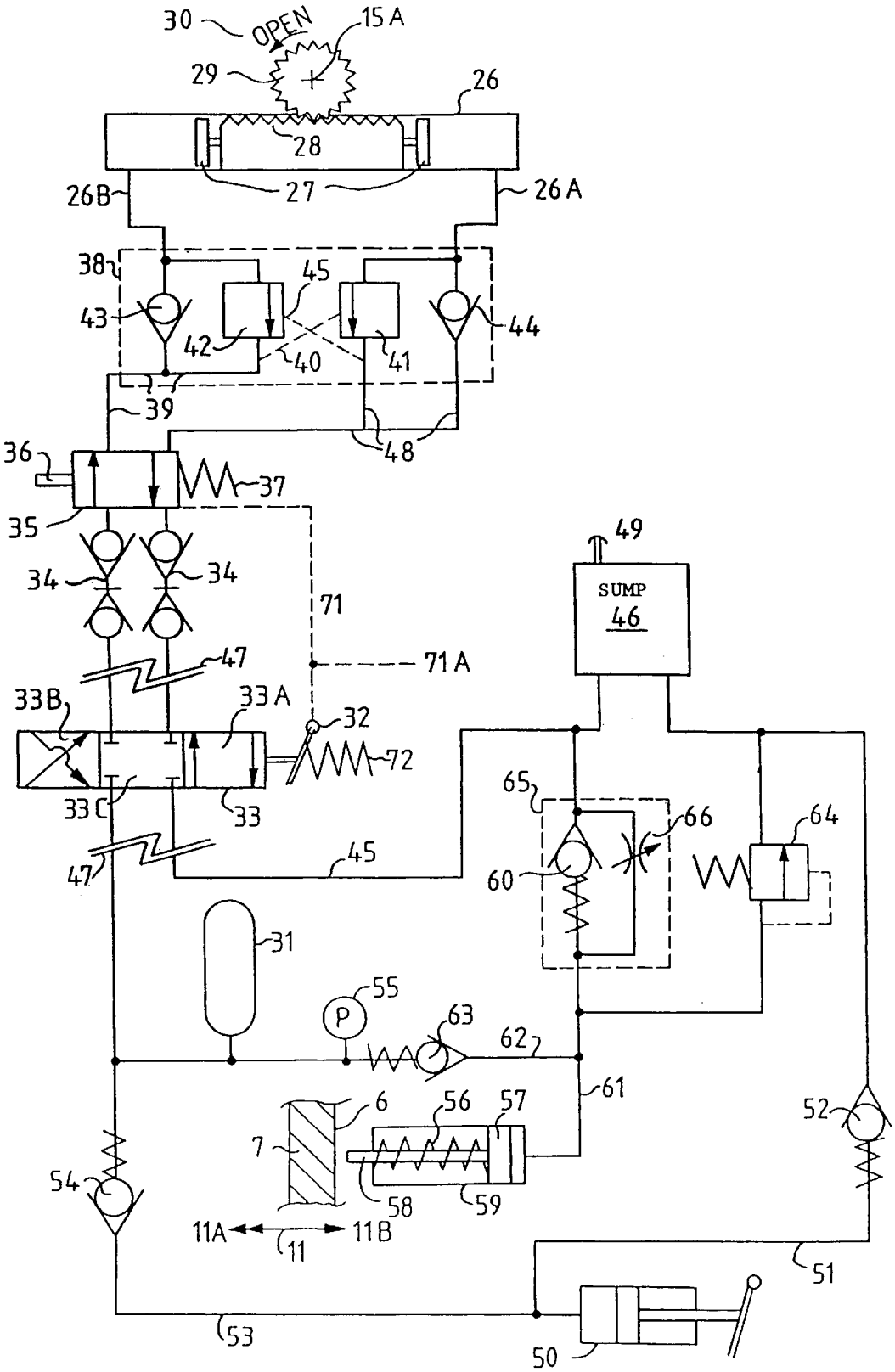
Figure 7:
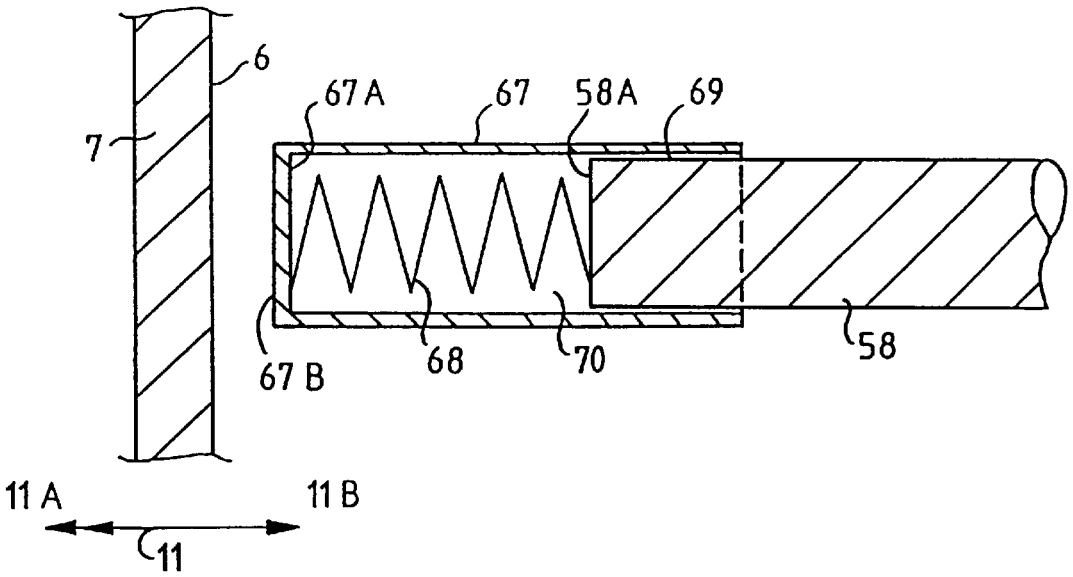
Figure 8:
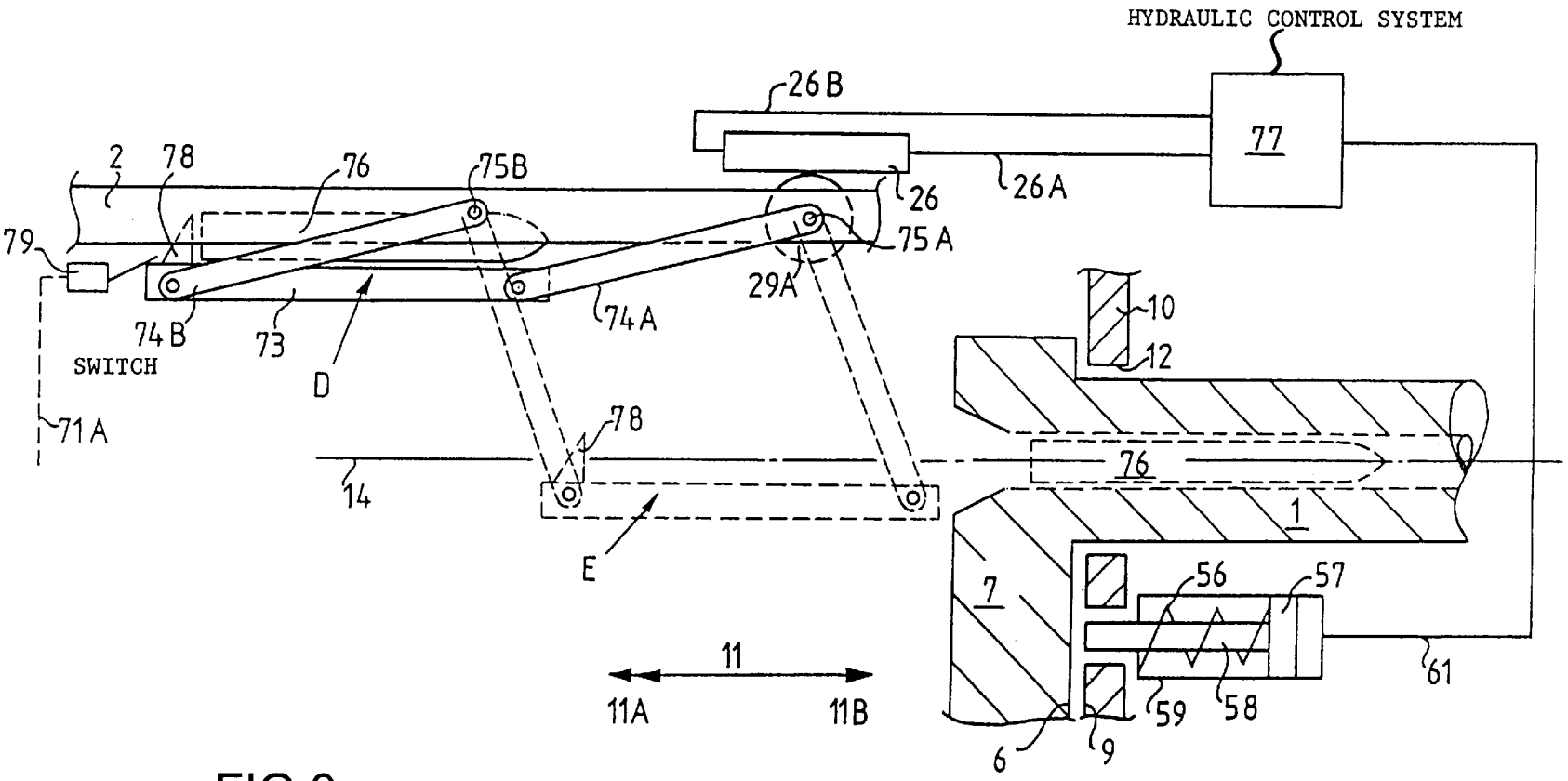
Figure 9:
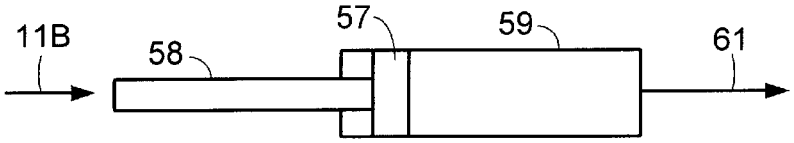
Figure 10:
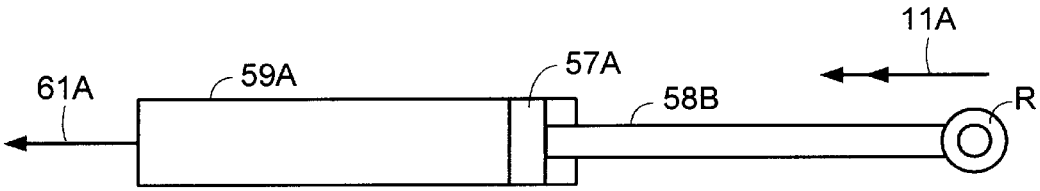
Figure 11:
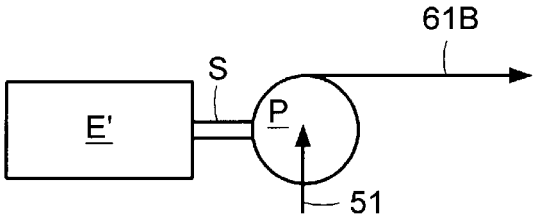
Figure 12:
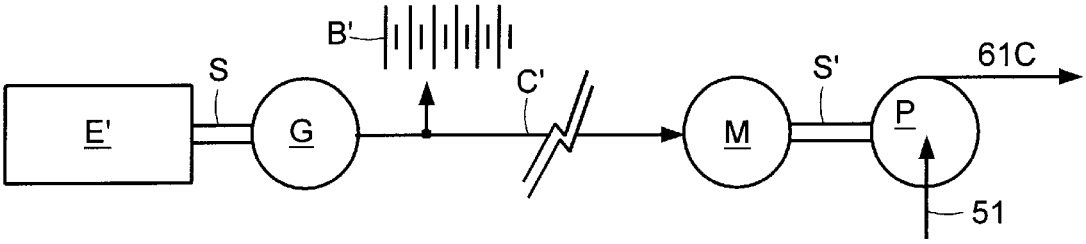
Figure 13:
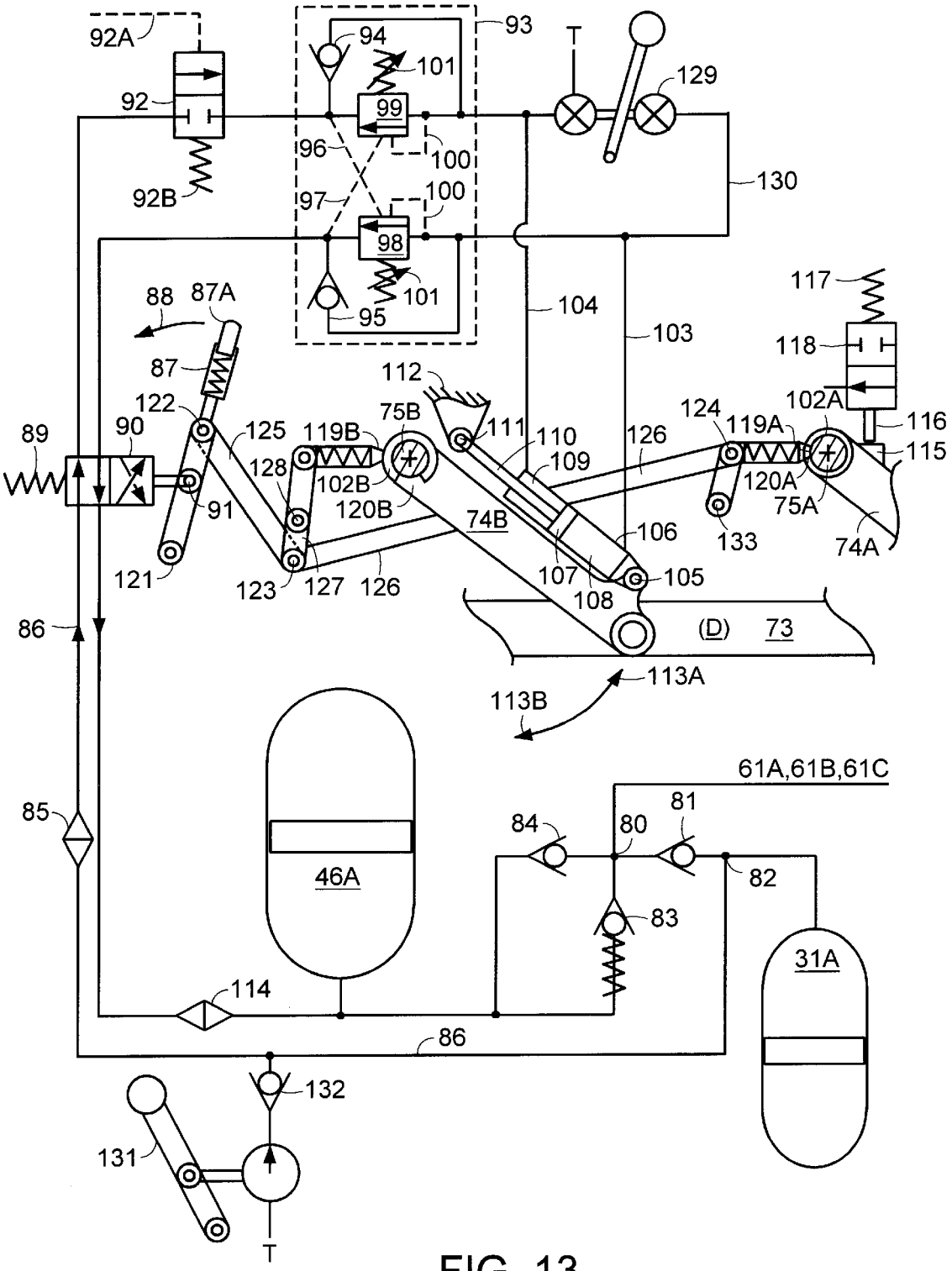

For a better understanding of the invention and to show how the same may be put into effect, reference will now be made, by way of example only, to the accompanying drawings, in which:

FIG. 1 is a block schematic representation of an ultra lightweight field howitzer in accordance with the invention, FIG. 2 is a diagram of the breech end of the barrel of the howitzer of FIG. 1, showing the breech in the open and closed positions, FIG. 3 is a diagrammatic sectional elevation of the breech end of the barrel of the howitzer of FIGS. 1 and 2, FIG. 4 is an elevation showing a dog-clutch forming part of the breech operating mechanism of the howitzer of FIG. 3, FIG. 5 is an elevation showing the dog clutch of FIG. 4 and its connection to a double acting hydraulic rotary actuator, FIG. 6 is a flow diagram of the hydraulic circuit in which the actuator shown in FIG. 5 is incorporated, FIG. 7 is a sectional elevation of a shock-absorbing mechanism incorporated in the breech mechanism of the howitzer of FIGS. 1 to 6, FIG. 8 is a diagrammatic representation of a modification of the howitzer of FIGS. 1 to 7 incorporating a power-operated loading tray, FIG. 9 is a diagrammatic representation of the conversion of run out energy 11B into hydraulic energy 61, using the directions of motion shown in FIG. 1, FIG. 10 is a diagrammatic representation of the conversion of recoil energy 11A into hydraulic energy 61A, using the direction of motion shown in FIG. 1, FIG. 11 is a diagrammatic representation of the generation of hydraulic power 61B using an internal combustion engine E, FIG. 12 is a diagrammatic representation of the use of an internal combustion engine to generate electrical power which is then used to run an electric motor which drives a pump to create energy 61C, and FIG. 13 is a block diagram of a hydraulic system for the operation of a loading tray.

In this description, the same reference number is used for identical components fulfilling the same role in different figures.

FIG. 1 shows a block diagrammatic representation of an ultra lightweight field howitzer comprising a barrel 1, mounted in a cradle 2, and supported via a trunnion bearing 3, in a chassis 4 with support/recoil legs 5. The barrel 1 terminates in a breech assembly 7 having a forward face 6 and the chassis 2 includes a beating plate 10 having a rearward face 9. In use, the forward face 6 and the rearward face 9 are juxtaposed and, for reasons of clarity, barrel 1 is shown removed from chassis 2 so that the juxtaposition of the forward face 6 can be shown, via dotted line 8, in relation to the rearward face 9. Two headed arrow 11 indicates the movement of barrel 1 in use. On firing, the barrel recoils violently rearwards, indicated by the double arrow 11A and then the barrel 1 recuperates forwardly more sedately, as indicated by arrow 11B to its run out position.

In the fully run out position, the front face 6 of the breech assembly 7 is hard against the rear face 9 of beating plate 10, as indicated by line 8.

FIG. 2 shows the breech end of barrel 1 of the howitzer. The juxtaposition of faces 6 and 9 is again shown with barrel 1 passing through a hole 12 in beating plate 10. The actual breech block consists of an obturator 13 and a member 16 and engages with mating screw threads in breech assembly 7. The screwing arrangement is such that limited rotational movement of member 16, about barrel axis 14 e.g. through angle $\alpha°$ will fully lock or fully unlock the breech block. Though member 16 rotates about barrel axis 14 to lock or unlock, mechanism 18 which actually operates the locking/unlocking of the breech block is driven from a rotational input via axis 15. As shown in FIG. 2, axis 15 is located at right angles to and above axis 14.

Referring to FIG. 3, the breech operating mechanism 18 is connected to a driven member 19 which can engage with a driving member 20 such that rotation of the driving member 20 about axis 15 though $\alpha°$ firstly unscrews the breech block. Further rotation about axis 15 then opens the breech, moving members 13, 16 together in an arc 17.

Designation A (FIG. 2) shows the normal closed position of the breech block 13, 16 both when the block is fully screwed home and fully unscrewed, i.e., equivalent to rotations of both 0° and $\alpha$ of the driven member 19 about axis 15. A further rotation of 90° by the driven member 19 about axis 15 opens the breech block 13, 16 to position B. This is the normal position for a conventional mechanical cam/lever system for operating the breech opening mechanism. By means of the present invention the breech block 13, 16 can be opened further to about 130°, as shown by position C. This additional degree of opening, greatly improves access to breech assembly 7 and into the bore of barrel 1, and is achievable only by means of a power-operated system.

A simple visual estimation of the size, and hence mass, of breech block 13, 16, and the distance of their centres of mass from axis 15 will indicate that a massive turning moment must be applied to driven member 19 rotating about axis 15 in order to open the breech to position B, if the gun is nearly horizontal, or to close it to position A, if the gun is at a high angle of elevation. In order to supply the necessary turning moment to driven member 19 about axis 15, a manually operated hydraulic pump has been used. However, hand pumping is time-consuming and physically exhausting and a system driven from a separate power source would be a great advantage. However, as the breech 7, 13, 16 and operating mechanism 18, 19 are integral with barrel 1, they are subject to violent recoil 11A and less violent recuperation 11B forces and movements. It is thus inappropriate to locate any form of hydraulic system on breech assembly 7, unless it is capable of withstanding the recoil forces. This would require a massive, robust system which would, of course, be incompatible with the requirements of the ultra lightweight design principles. A simple hand pump could be used, but this is too slow and physically exhausting to the operator.

The solution to this problem, in accordance with the present invention, is to provide a hydraulic power system in or on cradle 2 with a power transfer mechanism which is separable as the breech recoils, but is re-established by a mechanical connection when the recuperation is complete and the gun is fully run out.

FIG. 3 shows the principle of the separable mechanical drive connection. The breech operating mechanism includes an input shaft 25 rotatably mounted about axis 15. Surrounding shaft 25 are driven and driving members 19, 20 (respectively) having substantially semi circular concave inner faces. Driven member 19 is fast with shaft 25 and is also fast with the breech of the howitzer, i.e. with members 18, 13, 16 and 7; this connection is shown schematically by arrow 21. Driving member 20 is integral with actuator 26 (FIGS. 5 and 6) which is fast with cradle 2 and hence with beating plate 10, as indicated schematically by arrow 22.

The spacing between members 19 and 20 can be accurately set by means of adjustable spacer bolts 23 (FIG. 4) which are provided with lock nuts 24. Member 20 is rotatably mounted and is rotated by a hydraulic power system, as will be described hereinafter. Adjusters 23, 24 are thus set so that member 20 may rotatably drive member 19, and hence shaft 25, about axis 15 in either the clockwise or the anti-clockwise sense. If the adjusters 23, 24 are exactly set, there will be no relative motion between the heads of bolts 23 and surface 19A of member 19. As this is difficult to achieve, in practice, and to maintain on a field howitzer, faces 19A and the heads of bolts 23 are preferably made from hardened steel and lubricated, for example, with grease, to accommodate any minor degree of misalignment. Preferably a small gap for example of about 1 mm (not shown) is provided between the heads of bolts 23 and faces 19A so that no mechanical shock occurs on completion of the run out, i.e. when faces 6 and 9 come into contact. The presence of this gap does not significantly affect the rotary drive between members 19 and 20.

Two headed arrow 11 indicates the relative movement of barrel 1 and breech members 7 and 16, including driven member 19, input shaft 25 and the breech opening mechanism 18. It will be apparent from FIGS. 3 and 4 that, on firing the howitzer, members 7, 16, 19 and move violently to the left (arrow 11A) leaving members 20, 23 and 24 (relatively) stationary. After the recoil and during the recuperation, members 7, 16, 19 and 25 move steadily back to the right (arrow 11B) to re-establish the positions shown in FIGS. 3 and 4. The contact between face 6 of breech assembly 7 and face 9 of beating plate 10 defines the rest position at which the adjusting bolts 23 and nuts 24 are set. The word 'relatively' above is placed in parentheses to recognise that, though driving member 20 remains stationary relative to members 19 and 25, the whole gun, i.e., including cradle 2, chassis 4 and legs 5, undergoes considerable movement, vibration and the like during firing and absorbing the recoil and, to a lesser extent, during recuperation and run out.

The arrangement of driving member 20 and driven member 19, via bolts 23 disposed about input shaft 25 and axis 15, has been described. This unit is referred to as a 'dog clutch'. From previous reference to the turning moments required to open and close breech block 16, 13, an indication has been given of the large torques which must be applied to shaft 25 and hence transmitted by driving member 20 and driven member 19. It will be noted that there is no direct mechanical connection between members 19 and 20 to provide the reaction forces. There is, however, a mechanical reaction path from driving member 20, via the mounting (arrow 22) and cradle 2 (not shown) to beating plate 10. Similarly, arrow 21 indicates the mounting of driven plate 19 on breech assembly 7. Thus, the relative location of members 19 and 20 in the (barrel) axial direction 14, corresponding to arrow 11, is determined by whether or not face 6 of breech assembly 7 and face 9 of beating plate 10 are in direct contact. Similarly the relative location of members 19 and 20 in planes at right angles to that of arrow 11 are determined by the freedom of movement of the barrel 1 in cradle 2.

The recuperator and run out systems (not shown) of the howitzer exert a considerable force. Clearly as the run out proceeds, the actual axial force applied decreases as the gas volume of the recuperator increases and its pressure consequently falls. However, even at maximum run out, i.e., with faces 6 and 9 in hard contact, the recuperator pressure is still of the order of tonnes. Thus, unless the howitzer has been seriously damaged, or suffered a major failure, the recuperator pressure will be more than adequate to maintain the relative axial location of faces 6 and 9 and hence of members 19 and 20. It will also be noted that this large force, acting normally via face 6 onto face 9, provides a high frictional component to resist any reaction forces generated in planes at right angles to axis 14 (FIG. 2) due to the torque transmitted between members 20 and 19.

The main means of locating the barrel 1 in the cradle 2 is via lugs (not shown) which slide in axial guides (not shown). This means of location allows barrel 1 to move axially 11, but not radially. However, though both lugs and guides are precision machined, there must be some clearance if sliding motion is to occur and this clearance, possibly magnified by geometric factors, may have some affect on the alignment of members 19, 20 in planes radial to axis 11. However, any misalignment arising from this cause is unlikely to be more than 1–2 mm.

A further factor which will affect the alignment of members 19 and 20 is thermal expansion of the breech assembly 7 after a number of shells has been fired. The maximum likely increase in the bulk metal temperature is about 100° C. This is sufficient to cause radial expansion of breech assembly 7 and so cause driven member 19 and shaft 25 to move radially outwards (i.e., upwards as shown on FIG. 3) relative to driving member 20 mounted in relation to the cooler beating plate 10.

Thus the means of transmitting the rotary motion must be capable of working under conditions of limited misalignment. The hardened bolt heads 23, bearing on hardened surfaces 19A, are ideally adapted to this and lubrication can be provided to minimise scuffing damage.

Dog clutch 19, 20 must be 'double-acting' as effort is required to close as well as open the breech. For example, in the situation shown in FIG. 2, lower bolt 23 (FIG. 4) applies the force to unscrew the breech block and open it to positions B and C. On closing, lower bolt 23 controls the descent of breech block 13, 16, but the upper bolt 23 ensures that the obturator 13 is fully home before the block is screwed tightly closed. When the barrel 1 is at high angles of elevation, e.g., up to +70°, the division of the effort between the two bolts 23 will be different.

As indicated above, the howitzer employs a hydraulic power system to store energy obtained from the recoil of the barrel 1 and to transfer that energy when desired to impart rotary motion to the driving member 20 in order to open and/or close the breech 13,16.

The method by which the rotational drive is applied to driving member 20 will now be described with reference to FIGS. 5 and 6.

The double-hydraulic actuator 26 includes piston(s) 27 which are fast with a rack gear 28 which in turn meshes with a gearwheel 29 which is fast with driving member 20. Gearwheel 29 and driving member 20 rotate about axis 15A. If all the alignments are precise, axis 15A will coincide with axis 15. However, in practice, even perfect alignment when various components are cold may be slightly out when the components are hot for example, after firing so that minor misalignment can be accommodated via bolts 23 and surface 19A, as hereinbefore mentioned. It is, however, particularly desirable for gearwheel 29 and member 20 to be mounted in robust bearings (not shown) so that any reaction forces due to misalignment, etc. will not substantially affect the meshing of gear wheel 29 and rack 28.

A suitable hydraulic circuit is illustrated in FIG. 6. It should be noted that the sense of rotation 30 to open the breech is opposite to that shown in FIGS. 2, 3, 4 and 5.

Energy is stored in the hydraulic system by pressurisation of the system and after each opening or closing of the breech, the hydraulic system must be repressurised. This pressurisation could be achieved solely by means of a hand pump 50. However, due to the pumping effort required and the resulting fatigue of the operators this would limit the rate of fire to approximately 3 rounds per minute, whereas by means of the hydraulic system described hereinafter a burst rate of fire of 4 rounds per minute can be achieved. It will, of course, be appreciated that in this art speed of operation is a particularly important factor.

Thus, in practice the hand pump 50 is used only for initial pressurisation to operate the breech mechanism before the first round is fired. Hand pump 50 draws fluid from sump 46 via pipe 51 and non-return valve 52 and pressurised fluid is passed via pipe 53 and non-return valve 54 into accumulator 31. In an emergency, only sufficient fluid need be pumped to open the breech to 90° (Position B) and shut it again; pressure gauge 55 indicates when pumping has reached the required level.

When the hydraulic system is pressurised the breech can be opened by moving lever 32 to the left to open valve 33 thereby allowing direct flow 33A from accumulator 31, through connections 34 to safety valve 35. In the illustrated embodiment safety valve 35 can allow hydraulic fluid to pass only when plunger 36 has been moved to the right against return spring 37. As shown in FIG. 3, plunger 36 is mounted in, or close to, the beating plate 10 and is moved to the right only when breech assembly 7 is hard against the beating plate 10. On firing, the spring 37 returns the valve to the closed position, as shown in FIG. 6, and it will not re-open until faces 6 and 9 are in contact again.

After passing through safety valve 35, hydraulic fluid enters dual overcentre valve 38 via pipes 39 and the pressure builds up until, at a desired pressure, flow of fluid through internal port 40 causes outlet valve 41 to move to the right and allow flow out of actuator 26 via pipe 26A. Under these conditions, hydraulic fluid flows through non-return valve 43 and pipe 26B into actuator 26, causing piston(s) 27 to move to the right and displace hydraulic fluid which leaves actuator 26 via pipe 26A and outlet valve 41. Dual over centre valve 38 appears very complicated, but produces a smooth flow of hydraulic fluid through actuator 26 to ensure a uniform rate of rotation of gear wheel 29 and smooth opening (or closing) of the breech block 16, 13.

Movement of piston(s) 27 to the right causes gear wheel 29 to rotate anti-clockwise, as shown 30, and driving member 20 to operate the breech opening mechanism. Hydraulic fluid displaced from actuator 26 leaves via pipe 26A, outlet valve 41, pipe 48, safety valve 35, connector 34, valve 33A and pipe 45 to sump tank 46.

Symbols 47 indicate that long pipe runs could be involved and connectors 34 are quick-release devices that minimise loss of fluid. They are used to allow the howitzer to be separated into a small number of major components for ease of transport. The long pipe runs 47 allow components, such as the sump tank 46, to be located at the most appropriate positions on the howitzer.

To close the breech block lever 32 is moved to the right to bring reverse flow section 33B into operation. Flow is now into pipes 48 causing outlet valve 42 to open via pressure in internal port 45. Fluid now flows via non-return valve 44, moving piston(s) 27 to the left, and out via pipe 26B and outlet valve 42 back to sump 46. Vent 49 on the sump tank 46 eliminates the build up of back pressure or suction head.

It will be noted from FIG. 2 that the breech block 16, 13 must open to a 90° angle (Position B) to give clear access to the bore of barrel 1. This is the normal position for a mechanical opening system. However, when the hydraulic power is (relatively) unlimited, breech block 13, 16 can be opened a further 40° to point C (FIG. 2). This greatly improves access to the bore of barrel 1, especially when the howitzer is at high angles of elevation. In this case, the total angular movement of breech block 13, 16 is 90°+40°=130°.

The hydraulic system includes a piston 57 which moves in a cylinder 59. The piston 57 has a piston rod 58 and is biased by a biasing means such as a spring 56. The piston rod 58 is so disposed that in the runout position when the face 6 of the breech assembly 7 abuts the face 9 of the beating plate 10, the piston is held to the right in FIGS. 3 and 6 such that spring 56 is extended.

When the howitzer is fired, breech assembly 7 recoils in direction 11A from beating plate 10. This allows spring 56 to urge piston 57 and piston rod 58 to the left in cylinder 59, drawing in hydraulic fluid from sump tank 46 via a non-return valve 60. When the recoil 11A is complete, breech assembly 7 will start to move in direction 11B under the effect of the recuperation and face 6 will contact piston rod 58 which, by virtue of spring 56, is at this stage extended fully out of cylinder 59. The result is that piston rod 58 is forced to the right driving piston 57 to force fluid out of cylinder 59 into pipe 61. As valve 60 will shut under positive pressure in pipe 61, the fluid can flow only via pipe 62 and non-return valve 63 into accumulator 31. A pressure relief valve 64 protects against over pressurisation and discharges any excess fluid to sump 46.

When recuperation 11B is complete, there is a high residual pressure in pipes 61, 62. Valve 65 is a throttle check valve comprising non-return valve 60 and a variable throttle 66. The residual pressure in pipes 61, 62 escapes to tank 46 via throttle 66. The use of throttle 66 allows the shock absorber to reset itself preferentially as described hereafter.

It will be apparent to those skilled in the art that whilst the recoil 11A is violent, the recuperation 11B is also rapid so that face 6 of breech assembly 7 will strike the extended end of piston rod 58 with a significant impulse. As piston rod 58, piston 57 and the hydraulic fluid in cylinder 59 cannot instantaneously start moving with a velocity equal to that of breech assembly 7, without serious risk of buckling piston rod 58, a means is required to absorb the initial impulse and provide a small time interval during which piston rod 58 may be accelerated up to the velocity of breech assembly 7. FIG. 7 illustrates a suitable shock absorbing mechanism for this purpose.

A machined cylindrical cap 67 is provided which fits closely over the end of piston rod 58, as shown in FIG. 7. A spring 68 is disposed between end 58A of piston rod 58 and the flat inner end 67A of cap 67.

When the howitzer is fired, breech assembly 7 recoils in direction 11A and, free from its compressive loads, spring 56 moves piston 57 to the left with respect to cylinder 59. The rating of spring 56 and the resistance against which it operates is such that the motion is fully complete in the time interval between firing and the contact of faces 6 and 67B near the end of the recuperation and run out phase of the barrel motion. As described below, spring 68 will be fully extended before the howitzer is fired.

When face 6 strikes face 67B in the recuperation motion 11B, cap 67, which is light and strong, immediately starts to move to the right with the same velocity as that of face 6. In doing so, spring 68 is compressed. Thus the force of spring 68 acts on face 58A of piston rod 58 to cause it to start to move to the right. As the recuperation 11B continues, the compression on spring 68 increases as does the force on face 58A. The design ideal is that piston rod 58, and everything that it is driving, is accelerated to the velocity of face 6 before metal-to-metal contact 67A-68-58A occurs but, in practice, any significant acceleration imparted to piston rod 58 before hard impact with face 6 will greatly minimise the mechanical shock and consequent stress in piston rod 58.

Spring 68 is stronger than spring 56 so that, on completion of the run out, spring 68 extends causing further stretching of spring 56 and further movement of piston 57 to the right displacing further fluid via pipe 61 and throttle 66 to tank 46. The advantage is that the shock absorber is fully deployed and thus able to protect piston rod 58 from damage as soon as the next round is fired.

If cap 67 is a close fit over piston rod 58, the air 60 inside will not be able to escape quickly through annulus 69. Thus pneumatic pressure will also act on face 58A to supplement the action of spring 68.

As an alternative to the shock absorbing mechanism described, a hydraulic shock absorber or any combination of spring, hydraulic or pneumatic devices may be used.

As has been mentioned, the drive device of the invention has been primarily designed for use in an ultra lightweight howitzer. Although it is quite possible to design a piston rod 58 so robustly that the axial impacts from breech assembly 7 cause no undue stress, the magnitude of the axial impacts will generate considerable additional reaction forces, e.g. at the mounting points of cylinder 59 and on the guides in which barrel 1 slides. To accommodate these additional reaction forces, stronger structures are required, i.e., of more massive or better (more costly) materials. The use of a shock absorbing mechanism thus makes a substantial weight saving to the system and also contributes to the overall life of the howitzer for little additional complexity.

The method of operation of the howitzer will now be described. Firstly it will be assumed that the howitzer has been moved to near the battlefield and initial preparations to fire have been completed e.g. the legs 5 (FIG. 1) have been deployed, the shells have been brought up, etc. The breech operating mechanism is initially pressurised by means of hand pump 50 until the pressure 55 in accumulator 31 is adequate to open the breech preferably to position C, or at least to position B, and close it fully afterwards. The howitzer is then aimed and fired. Breech assembly 7 recoils in direction 11A allowing spring 56 to contract and move piston 57 and piston rod 58 to the left drawing hydraulic fluid from sump 46 via valve 60 and pipe 61 into cylinder 59. The spring 56 will have completed its travel by the time face 6 of breech assembly 7 has returned, in its recuperation phase, to strike outer face 67B of cap 67. The final part of the recuperation motion 11B causes the piston 57 to pump fluid through pipes 61, 62 and valve 63 into accumulator 31. Excess pressure is relieved via valve 64. When the gun has been fully run out, the residual pressure in pipes 61, 62 is relieved via throttle 66, allowing spring 58 to reset itself.

It will be noted that the pressurisation of accumulator 31 occurs during the final part of the run out phase. The howitzer is never fired unless fully run out, i.e., with faces 6 and 9 in intimate contact, so that piston 57 will have completed its stroke. It is possible for a howitzer to be fired with less than a full charge. In such a case, the howitzer would not recoil to its fullest extent, but would recoil sufficiently to enable piston 57 to complete its full leftward travel so that, on recuperation, accumulator 31 would be fully recharged. Thus after initial pressurisation by hand pumping 50, the firing of each round leaves the system fully charged to open and close the breech for the next round.

Hard contact between faces 6 and 9 aligns and brings into contact the driving and driven members 20, 19 of the dog clutch as well as moving plunger 36 to the right to open safety valve 35. This allows lever 32 of valve 33 to be moved to the left to open the breech to position C. Barrel 1 is then swabbed out and reloaded and the breech is closed manually by lever 32 which moves valve 33 to the right 33B. The howitzer can now be re-aimed and fired and the above sequence is then repeated.

Valve 33 may be manual, semi-automatic or fully automatic, as required. In the manual version, shown in FIG. 6, a spring 72 biases the valve to the central 33C shut position. In this position, a spring loaded pin (not shown) locks into a hole (not shown) so that the valve 33 cannot be operated without lifting the pin (not shown) and simultaneously moving lever 32, i.e. a two handed operation. Such a mechanism is known as a "detent" and minimises the risk of accidental, unintentional operation.

For semi-automatic operation, a link 71 is provided between safety valve 35 and the operation of the valve 33. In this case, when the run out is fully complete, movement of plunger 36 causes valve 33 to be moved to position 33A, which opens the breech to position C. After reloading, the breech 13, 16 is closed manually by lever 32 (33B) in conjunction with the "detent". Link 71 may be mechanical, electrical, hydraulic or pneumatic.

Fully automatic operation of the breech is also possible. In such a case, a second link 71A is used. This is operated by a hydraulic or electrical switch (not shown) activated by a suitable member on completion of its operation, e.g. by the return of the loading tray 73 (FIG. 8) to its rest position after loading the shell into the breech.

On completion of firing, the barrel 1 is cleaned, and oiled and the breech is closed manually by lever 32, and valve 33. Valves (not shown) to release residual hydraulic pressure to sump 46 may be operated, if required.

The above description discloses how the invention may be put into effect in one particular application where extremely high reliability is required. Variations of the embodiment disclosed and other arrangements offering, for example, lower levels of reliability will be apparent to the man skilled in the art and, all fall within the scope of the present invention.

The above described principle of taking some of the energy of the recoil, which is stored temporarily for use in the recuperation/run out, and converting it into a more permanent form of stored energy for use after the barrel has been fully run out, has other applications, for example in the operation of the shell loading mechanism, as shown diagrammatically in FIG. 8.

Referring to FIG. 8, the loading tray 73 is mounted on cradle 2 by a parallel arm linkage 74A and 74B which can pivot about mountings 75A and 75B respectively. Fast with linkage arm 74A is gearwheel 29A and both share a common axis of rotation 75A. Gearwheel 29A is rotated via actuator 26 and rack 28, as hereinbefore described, to cause loading tray 73 to move from its rest position D to its loading position E (shown dashed), and back again.

The operation of the actuator 26 is controlled by a hydraulic control system 77, for example similar to that shown in FIG. 6, which derives its supply of pressurised fluid from the movement 11A and 11B of piston 57 in cylinder 59, as described hereinbefore. In this variation of the howitzer, no dog clutch 19, 20 is required, as the loading tray remains at position D, stationary with respect to cradle 2, while the recoiling mass 1, 7 passes below and returns to its location at the beating plate 10.

In the example shown in FIG. 8, in its rest position the tray 73 is located above barrel axis 14 but movement up from below or laterally from one side is equally possible. Location of the tray 73 above the axis 14 is preferred as, due to the low height of axis 14 above ground level, it is convenient to use, particularly when the howitzer is at high angles of elevation. Movement of tray 73 from position D to position E is rapid so that shell 76 gains considerable kinetic energy via shell stop 78; this, possibly in conjunction with other means, flicks the shell 76 into the breech, as shown.

Tray 73 then returns to position D, where it operates a switch 79 to send a signal via linkage 71A to cause the breech control system (FIG. 6) to close the breech. Thus, this provides a fully automatic system, though manual overrides may be provided, as required.

The use of run out energy to operate the breech mechanism has been described and the requirement for a power-assisted loading tray has also been disclosed.

In a practical, lightweight design of gun, the amount of energy surplus to run out requirements is necessarily limited. The energy available must be sufficient to run out the gun whatever the angle of elevation. Thus, when the gun is at maximum elevation, say ±70°, considerably more energy is needed than when it is horizontal, or at angles of depression. Clearly any surplus energy must be additional to the maximum likely to be required for normal run out duties.

The field howitzer of the disclosure is designed to be ultralightweight so that it can be helicopter transportable. The total run out energy has to be contained within the gun structure and this structure has to be capable of containing repeated mechanical shocks from the moving mass as it returns to, and impacts with, the beating plate. The normal force holding the moving mass against the beating plate is several tonnes and this demands a substantial structure. Thus, any surplus energy requirement on top of that for normal run out is undesirable where weight is at a premium.

Thus, when overall lightness is the key criteria, surplus run out energy may be used to provide for either a powered breech or loading tray, but not both. However, other sources of hydraulic power are available.

FIG. 9 reproduces the gaining of run out energy 61 as described hereinbefore, i.e. with piston rod 58 being forced to the right and returning via spring 56 (FIGS. 6 and 8). On the same basis, FIG. 10 shows a cylinder 59A, fast with the cradle 2, and a piston rod 58B connected R to the recoiling mass. As the gun recoils 11A, piston 57A is forced into cylinder 59A, expelling hydraulic fluid 61A to high pressure storage 31A (FIG. 13). As the gun runs out 11B, piston 57A draws oil from low pressure storage accumulator 46A (FIG. 13), so that negligible run out energy is used. Hydraulic system 57A, 58B and 59A is additional to the recoil buffers (not shown) and so may be sized for any required duty. In FIG. 10, piston 57A is shown "pushing" oil to the left out through pipe 61A. Alternatively, it may "pull" and discharge fluid to the right via another similar pipe. In some applications, pulling is preferable as there is less risk of buckling the piston rod 58B.

Alternatively, or additionally, to using recoil (FIG. 10) or run out (FIG. 9) energy, a separate internal combustion engine E' may be used to drive a pump P via a shaft S (FIG. 11). Here the hydraulic fluid output is shown as 61B. Engine E' and pump P are preferably integral with the gun chassis. A further variation (FIG. 12), shows engine E' driving an electrical generator G with battery storage B'. Cable(s) C' are connected to an electric motor M on the/each gun to drive pump P and produce hydraulic output 61C. In this last option, each gun may have its own system, or a single engine E' may supply a whole battery of guns.

FIG. 13 shows a block diagram of one preferred form of tray operating mechanism. Hydraulic fluid 61, 61A, 61B or 61C from cylinder 59A or pump P is passed via connection 80 through non-return valve 81 into high pressure accumulator 31A. Pressure relief valve 83 is provided to discharge excess fluid to low pressure storage 46A. As the gun runs out 11B, the rightward motion of piston 57A (FIG. 10) draws hydraulic fluid from storage 46A via non-return valve 84 and connection 80 back into cylinder 59A.

The operation of the system may be either fully automatic or manually controlled; manual control 87 is shown in FIG. 13. Lever 87 is shown with a spring loaded button 87A which has to be depressed so that it cannot be moved in direction 88 accidentally. Spring 89 biases valve 90 and, via connection 91, lever 87 into the safe "TRAY UP" position clear of the breech.

The system will be described in the safe "TRAY UP" position, as shown in FIG. 13. Fluid passes from accumulator 31A, via connection 82 and pipe 86, through filter 85 to valve 90. As shown, valve 90 is biased to the right by spring 89 giving forward flow to valve 92. Valve 92 is a safety device which is operated by hydraulic pressure 92A to overcome spring 92B. Valve 92 is analogous to safety valve 35 (FIG. 6) and is operated mechanically when the moving mass returns to the beating face 9 so that the breech opening mechanism cannot be operated prematurely. Only when the breech is fully open, is pressure 92A applied to valve 92, so that tray 73 cannot be operated prematurely.

From valve 92, fluid flows to dual overcentre valve 93; this operates in exactly the same way as valve 38. Fluid flows through non-return valve 94 and also generates pressure in pipe 96 to open return valve 98. Refinements in valve 93 include a pipe 100, to enable excessive back pressure to operate valve 98, and adjustable springs 101. From valve 93, fluid flows via pipe 104 to the mechanism to operate tray 73.

Tray 73 is mounted by parallel motion arm linkages 74A, 74B moving in mountings 75A, 75B respectively. Coaxial with mountings 75A, 75B are annular rings 102A, 102B fast with arm linkages 74A, 74B respectively. One end of a hydraulic cylinder 106 is pivotally attached to pivot point 105 on linkage 74B. Cylinder 106 includes a piston 107 on piston rod 110 having an end pivotally attached to mounting 112 at pivot point 111. In this design piston rod 110 is fast at one end so that cylinder 106 moves relative to the piston 107. When the fluid flows from valve 93 through pipe 104, it enters volume 109 of cylinder 106, above the piston 107 causing cylinder 106 to move upwardly. As the cylinder 106 is pivotally fast at point 105 with linkage 74B, the effect is to cause linkage 74B to rotate anticlockwise, in direction 113A, about bearing 75B. As tray 73 is connected by both linkages 74A, 74B, it moves upwards with parallel motion to the position shown, clear of the breech.

The fluid displaced from volume 108 of cylinder 106 passes via pipe 103, valves 98 and 90, and filter 114 to low pressure storage 46A. When tray 73 is in the UP position, land 115 on linkage 74A contacts plunger 116 causing it to open valve 118 against the pressure of spring 117. Valve 118 is an interlock with the breech closing mechanism and will not allow this mechanism to operate until tray 73 is in the UP, safe position. Valves 92 and 118 fulfill identical roles; each stops one mechanism from working until the other is in the "safe" position. Valve 118 (FIG. 13) is equivalent to switch 79 (FIG. 8).

To present tray 73 to the breech, lever 87 is released by pressing button 87A against the spring and moving it to the left in direction 88. This moves valve 90 to the reverse flow position against spring 89. Fluid now flows from pipe 86 through non-return valve 95 and pipe 103 to volume 108 of cylinder 106. The pressure in volume 108 causes cylinder 106 to move downwards past piston 107, causing linkage 74B to rotate clockwise in direction 113B about mounting 75B and swing tray 73 down into line with the breech. The fluid displaced from volume 109 passes via pipe 104, valves 99, 92 and 90 and filter 114 to low pressure storage 46A.

The two positions of tray 73 are shown in the UP position as D and the DOWN position as E in FIG. 8, though as viewed from the opposite side. When tray 73 starts to move downwards in direction 113B, plunger 116 will lose contact with land 115 and so close valve 118, blocking the operation of the breech mechanism.

Mechanical locks are provided to secure tray 73 in both the UP and DOWN positions. These spring-loaded locks 119A and 119B engage with cut outs 120A and 120B in the annular rings 102A and 102B respectively. In the tray UP position, as shown in FIG. 13, lock 119A is engaged with cut out 120A in annular ring 102A. Operation of lever 87 to the DOWN position, i.e. movement to the left about fulcrum 121 in direction 88, moves links 125 and 126 via connections 122 and 123 respectively and, via connection 124, pulls lock 119A to the left about fulcrum 133, releasing it from cut out 120A. This allows linkages 74A and 74B to rotate in direction 113B. This movement of lever 87 in direction 88 causes lever 127 to pivot about fulcrum 128 and move lock 119B to the right, compressing the spring and urging the tip into contact with annular ring 102B. When tray 73 reaches the DOWN position, lock 119B engages with cut out 120B to lock tray 73 in the DOWN position. Linkages 74A, 74B rotate through about 90° between the UP and DOWN positions.

When lever 87 is moved back clockwise to the position shown in FIG. 13, connection 122 acts via link 125 to move connection 123 and rotate lever 127 anticlockwise moving lock 119B to the left and out of engagement with cut out 120B. At the same time, the movement of connection 123 moves link 126 to act, via connection 124, to urge lock 119A to the right for the tip to engage with cut out 120A as tray 73 reaches the UP position.

Mechanical locks are important as hydraulic systems can leak and, over time, considerable movement can occur. Sometimes, major leaks happen, e.g. fractures in flexible pipes etc; if such a leak occurred in the heat of battle and was not noticed, the equipment could be seriously damaged and become inoperable.

A mechanism 129 is provided to circulate fluid around the loop formed by pipes 104, 130 and 103 into, and out of, volumes 108 and 109. This facility allows tray 73 to be operated independently of the rest of the hydraulic system and will still function, even if the whole, or any part, of the rest of the system was inoperative. Any shortage of hydraulic fluid is supplied from a sump tank, designated T which may be the low pressure storage accumulator 46A.

A hand pump 131 is provided drawing hydraulic fluid from tank T and passing it via a non-return valve 132 and pipe 86 to pressurise accumulator 31A. Pump 131 is used to pressurise the system prior to use.

In a typical installation, the high pressure accumulator 31A is precharged to about 60 bar and the low pressure accumulator 46A to about 2 bar using an inert, or non-reactive gas. Then, using hand pump 131, fluid from tank T is pumped into accumulator 31A to raise the pressure to near the maximum of the working range. A typical working range is from 100 to 150 bar in accumulator 31A and from 5 to 10 bar in accumulator 46A.

The capacities of accumulators 31A and 46A are sized in accordance with the required duties which may include some or all of the following:

open the breech move the tray 73 to DOWN loading position (E in FIG. 8)

flick ram a shell into the breech move tray 73 to UP safe position (D in FIG. 8)

close the breech

After having completed its design cycle of operations, the pressure in accumulator 31A will have fallen to, for example, 100 bar and that in accumulator 46A will have risen to, for example, 10 bar. Thus the working pressure differential will have fallen to 90 bar (100–10). Effectively a given volume of working fluid will have been transferred from the high pressure accumulator 31A to the low pressure accumulator 46A, but this causes different pressure changes in each due to the different internal oil and gas volumes of each. When the gun is fired, recoils and runs out, the given volume of working fluid is removed from the low pressure accumulator 46A and replaced in the high pressure accumulator 31A, as hereinbefore described, thus restoring the working pressure differential to 145 bar (150–5).

In the example given, the working pressure differential varies between 145 and 90 bar. Clearly the system must operate correctly at the minimum of these pressures but the equipment scantlings must be able to withstand the maximum pressure (plus safety margin). With the systems shown in FIGS. 11 and 12, a continuous output 61B or 61C is provided at a constant pressure of, for example, 100 bar. There would be thus no large changes in working pressure differentials. This allows a small reduction in scantlings and gives some weight saving to offset that of the additional components shown in FIGS. 11 and 12.

LIST OF NUMBERED ITEMS

| | |
|---|---|
| A | Breech in closed position |
| B | Breech opened to 90° position |
| C | Breech opened to maximum 130° position |
| D | Loading tray in rest position |
| E | Loading tray in position to load shell in barrel 1 |
| 1 | Barrel |
| 2 | Cradle |
| 3 | Trunnion Bearing |
| 4 | Chassis |
| 5 | Support/recoil absorbing legs |
| 6 | Forward face of breech block 7 |
| 7 | Breech assembly |
| 8 | Dotted line |
| 9 | Rearward face of beating plate 10 |
| 10 | Beating plate |
| 11 | Two headed arrow/axis of barrel 1 |
| 11A | Recoil |
| 11B | Recuperation/Run out |
| 12 | Hole in beating plate |
| 13 | Obturator |
| 14 | Axis of barrel and breech |
| 15 | Axis of drive to breech opening mechanism |
| 15A | Axis of hydraulic rotary drive to member 20 |
| 16 | Screwed breech block |
| 17 | Breech opening arc |
| 18 | Breech opening mechanism |
| 19 | Breech opening driven member |
| 19A | Hardened surface on member 19 |
| 20 | Breech opening driving member |
| 21 | Connection between driven member and breech opening mechanism |
| 22 | Connection between driving member and beating plate 10 |
| 23 | Adjustable spacer bolts |
| 24 | Lock nuts |
| 25 | Breech opening drive shaft |
| 26 | Double acting hydraulic actuator |
| 26A | Pipe/connection to actuator 26 |
| 26B | Pipe/connection to actuator 26 |
| 27 | Piston(s) |
| 28 | Rack gear |
| 29 | Gearwheel |
| 29A | Gearwheel used to operate parallel linkage 74 |
| 30 | Opening rotation of gearwheel 29 |
| 31 | Accumulator |
| 32 | Lever |
| 33 | Three position valve |
| 33A | Direct flow |
| 33B | Reverse flow |
| 33C | Shut |
| 34 | Quick acting connector/disconnector |
| 35 | Safety valve/automatic operation |
| 36 | Plunger |
| 37 | Return spring |
| 38 | Dual overcentre valve |
| 39 | Pipes |
| 40 | Internal port |
| 41 | Outlet valve |
| 42 | Outlet valve |
| 43 | Non-return valve |
| 44 | Non-return valve |
| 45 | Internal port |
| 46 | Sump tank |
| 47 | Distance symbol |
| 48 | Pipes |
| 49 | Vent |
| 50 | Hand pump |
| 51 | Pipe |
| 52 | Non-return valve |
| 53 | Pipe |
| 54 | Non-return valve |
| 55 | Pressure gauge |
| 56 | Spring |
| 57 | Piston |

-continued

LIST OF NUMBERED ITEMS

| | | |
|---|---|---|
| 58 | Piston rod | |
| 58A | End face of piston rod 58 | |
| 59 | Cylinder | |
| 60 | Non-return valve | |
| 61 | Pipes | |
| 62 | Pipe | |
| 63 | Non-return valve | |
| 64 | Pressure relief valve | |
| 65 | Throttle check valve | |
| 66 | Variable throttle | |
| 67 | Close-fitting cylindrical cap | |
| 67A | Flat inner end of cap 67 | |
| 67B | Flat outer end of cap 67 | |
| 68 | Spring | |
| 69 | Annulus | |
| 70 | Air inside cap 67/space | |
| 71 | Mechanical or electrical linkage | |
| 71A | Mechanical or electrical linkage | |
| 72 | Spring | |
| 73 | Loading tray | |
| 74A | Parallel linkage | |
| 74B | Parallel linkage | |
| 75A | Parallel arm pivot and axis of rotation of gearwheel 29A | |
| 75B | Parallel arm pivot | |
| 76 | Shell | |
| 77 | Hydraulic control system | |
| 78 | Shell stop | |
| 79 | Switch | |
| B' | Battery | |
| C' | Cable | |
| E' | Engine | |
| G | Generator of Electricity | |
| M | Motor (hydraulic) | |
| P | Pump | |
| R | Connection to recoiling mass | |
| S | Shaft | |
| T | Tank | |
| 31A | HP accumulator | |
| 46A | LP Storage | |
| 57A | Piston | |
| 58B | Piston rod | |
| 59A | Cylinder | |
| 80 | Connection | |
| 81 | Non-return valve | |
| 82 | Connection | |
| 83 | Pressure relief valve | |
| 84 | Non return valve | |
| 85 | Filter | |
| 86 | Pipe | |
| 87 | Manual control lever | |
| 88 | Motion of lever 87 to operate tray 73 | |
| 89 | Spring | |
| 90 | Valve | |
| 91 | Connection | |
| 92 | Safety | |
| 92A | Hydraulic connection | All internal to 93 |
| 92B | Spring | All internal to 93 |
| 93 | Dual over centre valve | All internal to 93 |
| 94 | Non return valve | All internal to 93 |
| 95 | Non return valve | All internal to 93 |
| 96 | Pipe | All internal to 93 |
| 97 | Pipe | All internal to 93 |
| 98 | Valve | All internal to 93 |
| 99 | Valve | All internal to 93 |
| 100 | Pipe | All internal to 93 |
| 101 | Spring adjustment | |
| 102A | Annular ring | |
| 102B | Annular ring | |
| 103 | Pipe | |
| 104 | Pipe | |
| 105 | Pivot | |
| 106 | Cylinder | |
| 107 | Piston | |
| 108 | Volume in cylinder 106 | |
| 109 | Volume in cylinder 106 | |
| 110 | Piston rod | |
| 111 | Pivot | |

-continued

| LIST OF NUMBERED ITEMS | |
|---|---|
| 112 | Mounting |
| 113 | Motion of linkages 74A, 74B |
| 114 | Filter |
| 115 | Land |
| 116 | Plunger |
| 117 | Spring |
| 118 | Valve |
| 119A | Mechanical locks |
| 119B | Mechanical locks |
| 120A | Cut out in 102A |
| 120B | Cut out in 102B |
| 121 | Fulcrum |
| 122 | Connection |
| 123 | Connection |
| 124 | Connection |
| 125 | Link |
| 126 | Link |
| 127 | Lever |
| 128 | Fulcrum |
| 129 | Mechanism |
| 130 | Pipe |
| 131 | Hand pump |
| 132 | Non return valve |

we claim:

1. A gun comprising a power-operated breech mechanism and a drive device operative to actuate said breech mechanism, the drive device comprising:

(i) a driving member;

(ii) a driven member; and (iii) a first element and a second element wherein the second element is moveable relative to the first element between a first position at which the first and second elements abut, and a second position at which the first and second elements are spaced apart, the arrangement being such that the second element approaches and contacts the first element on returning to the first position, wherein (iv) the driving member is connected to the first element and the driven member is connected to the second element so that the driving member and the driven member are separable as the elements move between their first and second positions and reengageable as the elements move between their second and first positions;

(v) the respective connections between said driving member and said first element and between said driven member and said second element permit when the driving and driven members are engaged, said driving and driven members to execute a rotary motion about an essential common axis; and (vi) energy is transferred to the driving member thereby to drive the driven member when the driving member and the driven member are engaged, wherein said energy transferred to the driving member is energy derived from movement of the second element from the first position to the second position.

2. A gun comprising a power-operated breech mechanism and a drive device operative to actuate said breech mechanism, the drive device comprising:

(i) a driving member;

(ii) a driven member; and (iii) a first element and a second element wherein the second element is moveable relative to the first element between a first position at which the first and second elements abut, and a second position at which the first and second elements are spaced apart, the arrangement being such that the second element approaches and contacts the first element on returning to the first position, wherein (iv) the driving member is connected to the first element and the driven member is connected to the second element so that the driving member and the driven member are separable as the elements move between their first and second positions and reengageable as the elements move between their second and first positions;

(v) the respective connections between said driving member and said first element and between said driven member and said second element permit when the driving and driven members are engaged, said driving and driven members to execute a rotary motion about an essential common axis; and (vi) energy is transferred to the driving member thereby to drive the driven member when the driving member and the driven member are engaged, wherein said energy transferred to the driving member is energy derived from an internal combustion engine.

3. A gun as claimed in claim 1 wherein said energy additionally actuates a loading tray for feeding ammunition to the breech of the gun.

4. A gun as claimed in claim 2, wherein said energy additionally actuates a loading tray for feeding ammunition to the breech of the gun.

* * * * *